US006301841B1

(12) United States Patent
Rhebergen et al.

(10) Patent No.: US 6,301,841 B1
(45) Date of Patent: Oct. 16, 2001

(54) METHOD FOR ERECTING A STRUCTURE FOR AN EMERGENCY POWER LINE, APPARATUS AND KIT OF PARTS THEREFOR

(75) Inventors: Bertus Rhebergen, Zevenaar; Joseph Franciscus Van Wolven, Duiven, both of (NL)

(73) Assignee: N. V. Kema, Arnhem (NL)

( * ) Notice: Subject to any disclaimer, the term of this patent is extended or adjusted under 35 U.S.C. 154(b) by 0 days.

(21) Appl. No.: 09/445,752

(22) PCT Filed: Jun. 22, 1998

(86) PCT No.: PCT/NL98/00360

§ 371 Date: Apr. 7, 2000

§ 102(e) Date: Apr. 7, 2000

(87) PCT Pub. No.: WO98/59136

PCT Pub. Date: Dec. 30, 1998

(30) Foreign Application Priority Data

Jun. 20, 1997 (NL) ..... 1006373

(51) Int. Cl.[7] ..... E04H 12/34

(52) U.S. Cl. ..... 52/123.1; 52/745.18; 52/749.1; 52/118

(58) Field of Search ..... 52/745.18, 123.1, 52/749.1, 118

(56) References Cited

U.S. PATENT DOCUMENTS

| | | | | |
|---|---|---|---|---|
| 1,758,389 | * | 5/1930 | Bushnell | 52/749.1 |
| 2,992,710 | | 7/1961 | Thomson . | |
| 3,495,370 | * | 2/1970 | Habro et al. | 52/118 |
| 4,309,854 | * | 1/1982 | Vendramini | 52/118 |
| 4,785,592 | * | 11/1988 | Hung | 52/118 |
| 4,837,992 | * | 6/1989 | Hashimoto | 52/118 |
| 4,932,175 | * | 6/1990 | Donnally | 52/118 |
| 5,794,387 | * | 8/1998 | Crookham | 52/749.1 |
| 5,833,430 | * | 11/1998 | Reynolds et al. | 52/749.1 |

FOREIGN PATENT DOCUMENTS

| | | |
|---|---|---|
| 2522158 | 11/1976 | (DE) . |
| 0736651 | 10/1996 | (EP) . |
| 1409888 | 10/1975 | (GB) . |

* cited by examiner

*Primary Examiner*—Beth A. Stephan
*Assistant Examiner*—Dennis L. Dorsey
(74) *Attorney, Agent, or Firm*—Banner & Witcoff, Ltd.

(57) ABSTRACT

Method for erecting an emergency mast (1) for a power line comprising mast elements placed one on top of another, comprising the following steps: arranging a guide device (19) at the location where the emergency mast has to be placed; arranging a first mast element (5) adjacently of the guide device; raising the first mast element by means of the guide device to a height such that a following mast element can be placed under the first mast element; placing a following mast element under the first mast element and connecting the following mast element to the mast element situated thereabove; raising the thus obtained combination by means of the guide device to a height such that a following element can be placed under the combination; repeating the latter two steps until the mast has reached the required height; and removing the guide device.

19 Claims, 3 Drawing Sheets

1/3

1
2
3
4
5
6
7
8
9
10
11
12
13
14
15
16
17

METHOD FOR ERECTING A STRUCTURE FOR AN EMERGENCY POWER LINE, APPARATUS AND KIT OF PARTS THEREFOR

BACKGROUND OF THE INVENTION

The present invention relates to a method for erecting an emergency mast for a power line comprising mast elements placed one on top of another.

Emergency masts for power lines are used after one or more of the original masts have been destroyed by for instance a natural disaster such as an earthquake or tornado, another type of disaster or by sabotage. Emergency power masts can also be deployed to replace a faulty underground cable connection or as temporary connection to replace a cable or above-ground power line which is to be repositioned. There is therefore a need for a mast which can be erected quickly in such emergency situations. This mast can be used per se when only a single mast has been damaged by the disaster, or a series of masts can be used when a significant part of such a power line has been destroyed. Known from the prior art, for instance the KEMA brochure and ELECTRON "Emergency lines . . . , you may need them sooner than you think" is an emergency power pylon which is assembled lying on the ground and subsequently erected by means of a crane, by means of a pivoting hoisting boom or using a helicopter. It is also known to assemble a mast in the erected situation by mounting each of the subsequent elements on top of the already existing mast part using a boom suspended in cables.

All these known methods have drawbacks.

Assembly on the ground thus requires extensive lifting equipment which is usually difficult to take to the intended location and which requires much manpower. It is noted here that such emergency power pylons must usually be erected at locations which are difficult to reach and which are often not flat, so chat the available space is small and assembly and erection in this manner involve difficulties.

It is of course simpler to construct the mast elements by stacking, although this is dangerous because operations take place increasingly higher in the mast, wherein the mast elements must moreover be hoisted upward. This also requires the necessary lifting equipment and in particular the professional skill. In addition, the method is time-consuming because the guys must be constantly displaced.

GB-A 1 409 888 discloses a method for erecting a mast comprising mast elements placed one on top of another, comprising the following steps of:

arranging a lifting device at the location where the emergency mast has to be placed;

arranging a first mast element close by the lifting device;

raising the first mast element by means of the lifting device to a height such that a following mast element can be placed under the first mast element;

placing a following mast element under the first mast element and connecting the following mast element to the mast element situated thereabove;

raising the thus obtained combination by means of the lifting device to a height such that a following element can be placed under the combination;

repeating the latter two steps until the mast has reached the required height.

This known prior art relates to a temporary mast structure for a single radio mast or single signal mast.

The use as a temporary mast in a power line necessitates the use of several and sometimes large numbers of masts.

The use of the prior art construction would imply the use of a separate lifting device for each of the masts. This is undesirable for logistic reasons.

BRIEF SUMMARY OF THE INVENTION

The aim of the invention is to provide such a method and the mast which result in a mast fit for a power line.

This aim is reached in that the lifting device is located next to the location where the mast is to be erected;

the lifting device comprises at least one mast element from which at least two lifting frames extend, and after the mast has reached the required height, the lifting device is removed.

These features result in the removability of the lifting device so that a single lifting device can be used for the erection of several masts leading to important logistic savings.

According to a preferred embodiment, suspension means for the high-voltage cables are arranged on the elements for placing high in the mast, while the relevant elements are situated at a low height adjacently of the guide device, wherein a work platform is also present.

This measure prevents that such usually heavy insulators forming the suspension means have to be handled by people at the top of the mast. This in any case involves dangers and requires much human effort.

According to another preferred embodiment, the mast elements are raised by means of a manually driveable winch mounted on the guide element. By choosing a winch of small diameter and possibly a transmission, the force necessary for pressing upward of the already partially mounted mast can be limited considerably. This has the advantage that this force can be exerted by manual effort so that no separate equipment is required for this purpose. This equipment is in any case not usually available in such emergency situations. It is also possible to make use of a light electric motor or a pneumatic or hydraulic drive.

It will be apparent that such an emergency mast will have to be guyed. It is noted here that the usual power pylons are not generally guyed; they take a wide form at their bottom. This is not possible with emergency power pylons; the components required for this purpose would be much too large or far too many components would be needed, whereby erection of such an emergency mast would take too long and require too much material. This is prevented by guying. Only after the mast has reached the final height are the guys fastened to their ground anchors and tensioned.

It is noted here that the guys are fixed to the mast elements by means of junction boxes which are also suitable for fixing of the insulating suspension elements.

The invention moreover relates to an apparatus for erecting an emergency power pylon formed from mast elements, comprising a frame for placing on the ground, guide means mounted on the frame at a distance from the ground at least corresponding with the height of the mast elements for guiding the mast elements of the power pylon for erection, and a winch mounted on the frame.

This apparatus is particularly suitable for performing a method according to the present invention; mast elements are herein placed and connected in each case to the mast element lying above, wherein the thus obtained assembly is pulled upward by means of the winch. Wound onto the winch for this purpose is a cable which can be coupled to the lowest mast element to be moved upward.

According to a preferred embodiment, the guide means comprise at least two guide sub-frames which are arranged at different heights on the frame and which are each adapted to enclose the mast elements. An adequate guiding of the mast elements thus takes place, which is necessary up to the stage at which guys are attached, since up until then the mast elements are only supported by the guide device.

According to another preferred embodiment, the frame is assembled from at least two mast elements. It will be apparent that this measure limits the number and variety of the components.

The present invention therefore provides a kit of parts for assembling at least one emergency power pylon, comprising at least mast elements and suspension means, and a guide device is included in the kit of parts.

In preference the kit of parts is placed in a closable container together with the mast components. The container can thus be taken quickly to the location where the emergency power pylon has to be erected. The container is provided for this purpose with all relevant parts. The container can be easily transported with usual transporting means, for instance a truck, train or ship.

BRIEF DESCRIPTION OF THE SEVERAL VIEWS OF THE DRAWINGS

The present invention will be elucidated hereinbelow with reference to the annexed drawings, in which.

DETAILED DESCRIPTION OF THE INVENTION

Figure 1:
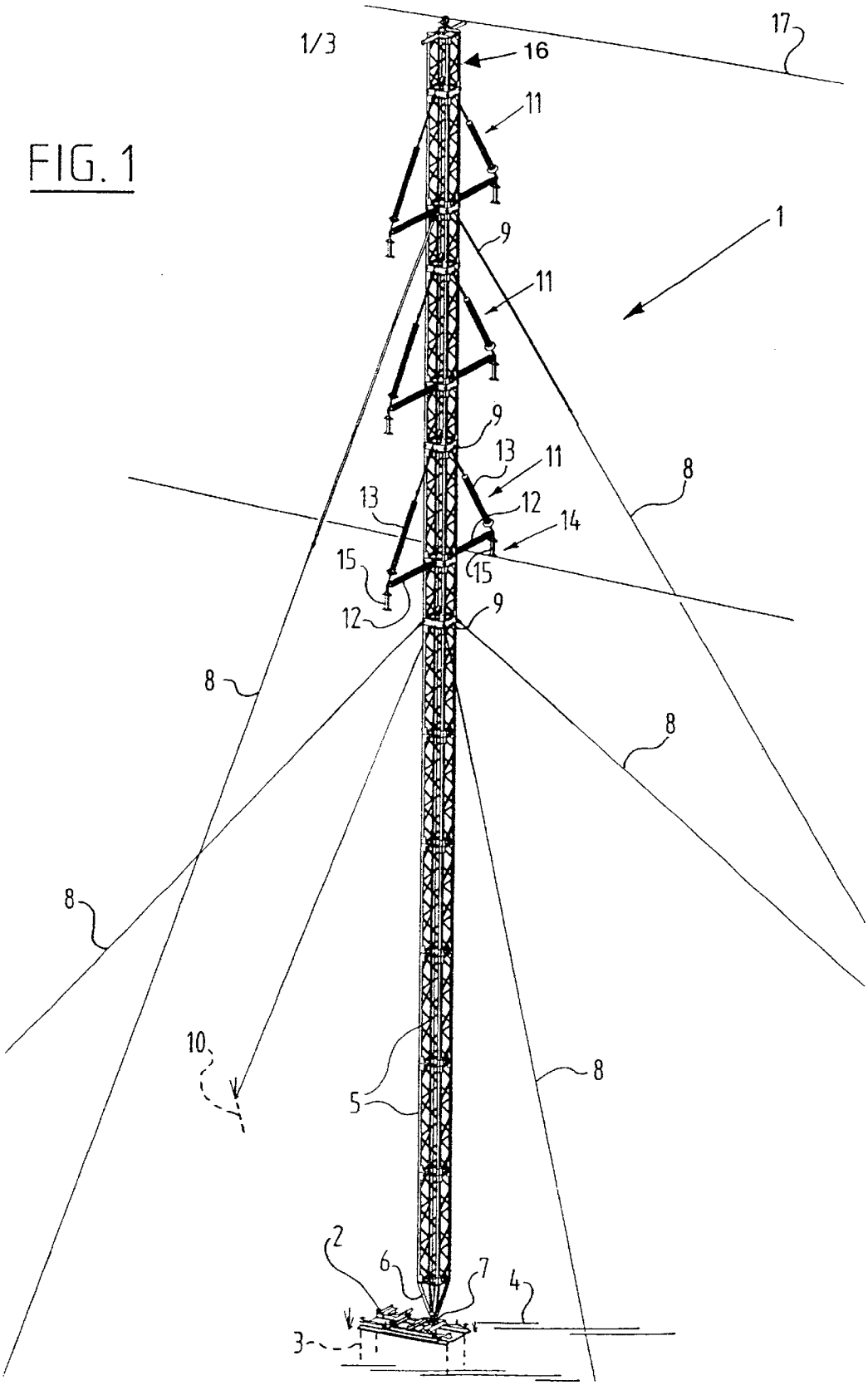
FIG. 1 shows a perspective view of a first embodiment of a power pylon erected with the method according to the present invention.

FIG. 1 shows a power pylon designated as a whole with 1. Mast 1 comprises a foot-plate 2 which is fixed in the ground by means of pins 3. It will be possible to apply other fastenings for foot-plate 2 depending on the ground type.

Constructed on the foot-plate 2 is the actual mast in the narrower sense which is formed by mast elements 5. Each of the mast elements 5 is formed by a lattice structure to keep the weight as low as possible with a sufficiently great strength.

Mast elements 5 are mutually connected by releasable connections, for instance screw connections. The mast elements each have dimensions such that they can be easily handled by four people. This avoids the necessity of lifting equipment for handling of the mast elements. The lowest mast element is fixed to foot-plate 2 by means of a pyramid-shaped element 6. This latter is fixed to foot-plate 2 by means of a universal joint 7 in order to prevent stresses in the connection in question and to enable placing of the mast at all times in the correct vertical position.

To hold the mast upright use is made of guys 8. Guys 8 are fastened to a junction box 9 which is mounted between mast elements 5. At their bottom end the guys 8 are secured to anchors 10. In the embodiment shown in FIG. 1 there are two series of guys 8 one above the other. One series is usually sufficient. It will be apparent that in order to achieve an adequately fixed situation, guys 8 are necessary in at least three directions.

Suspension means are further arranged to bear the high-voltage conductors. In the present embodiment a suspension device 11 is herein arranged for a single conductor. There may also be two per suspension point. Each suspension device 11 comprises an insulator 12 which extends substantially horizontally and which is fixed on the mast side to a junction box 9 and an obliquely extending insulator 13. The obliquely extending insulator 13 is also fixed on the mast side to the mast by means of a similar junction box 9. The distal ends of both insulators 12,13 are mutually connected and provided with supporting means for supporting the high-voltage conductor(s) 14.

It is herein noted that the horizontal insulator 12 is only under strain of pressure. Conductor 14 is fixed to the connecting point of both insulators by means of a mounting element 15. This latter is adapted to allow the conductors to rotate when they are being tensioned, but is likewise adapted to fix the conductors to the mounting element once the conductors have been arranged. A total of six such devices are arranged in the present embodiment, in this case two per stage. It will be apparent that other configurations are possible.

At the top of the mast is arranged a supporting device 16 for a neutral line 17 and a hoisting beam 28 for hoisting up insulators 12,13.

Figure 2:
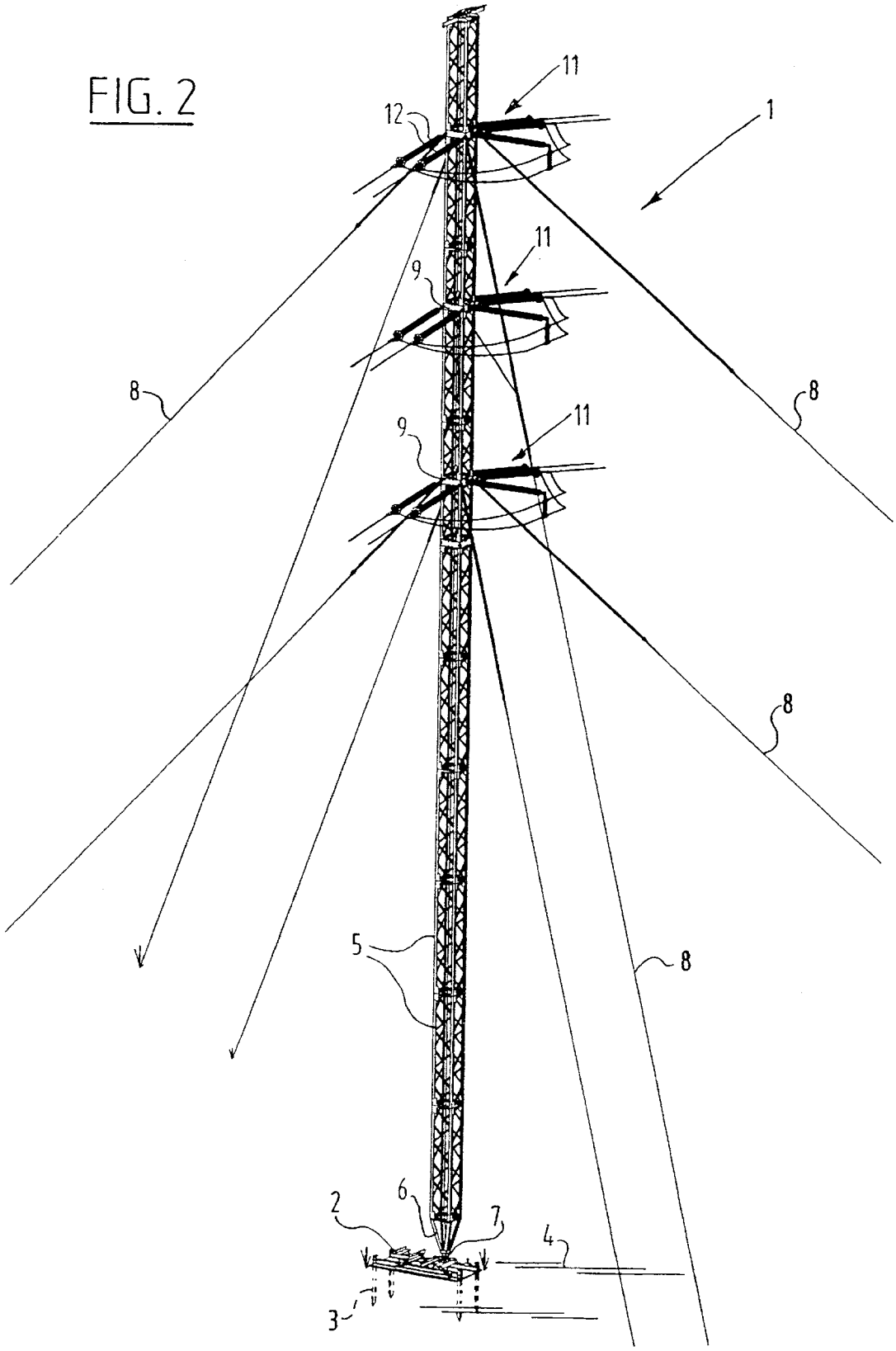
FIG. 2 shows a perspective view of a second embodiment of a power pylon erected with the method according to the present invention.

FIG. 2 shows a similar mast, which varies from the mast depicted in FIG. 1 in the different configuration of the insulators. The mast shown in FIG. 2 is for instance suitable for placing in a corner point of a power line where the resultant of the forces exerted by the conductors on the mast substantially does not equal zero. Only a single insulator is herein used per conductor side. However, two insulators are used per conductor to transmit the forces of the conductor to each side.

Figure 3:
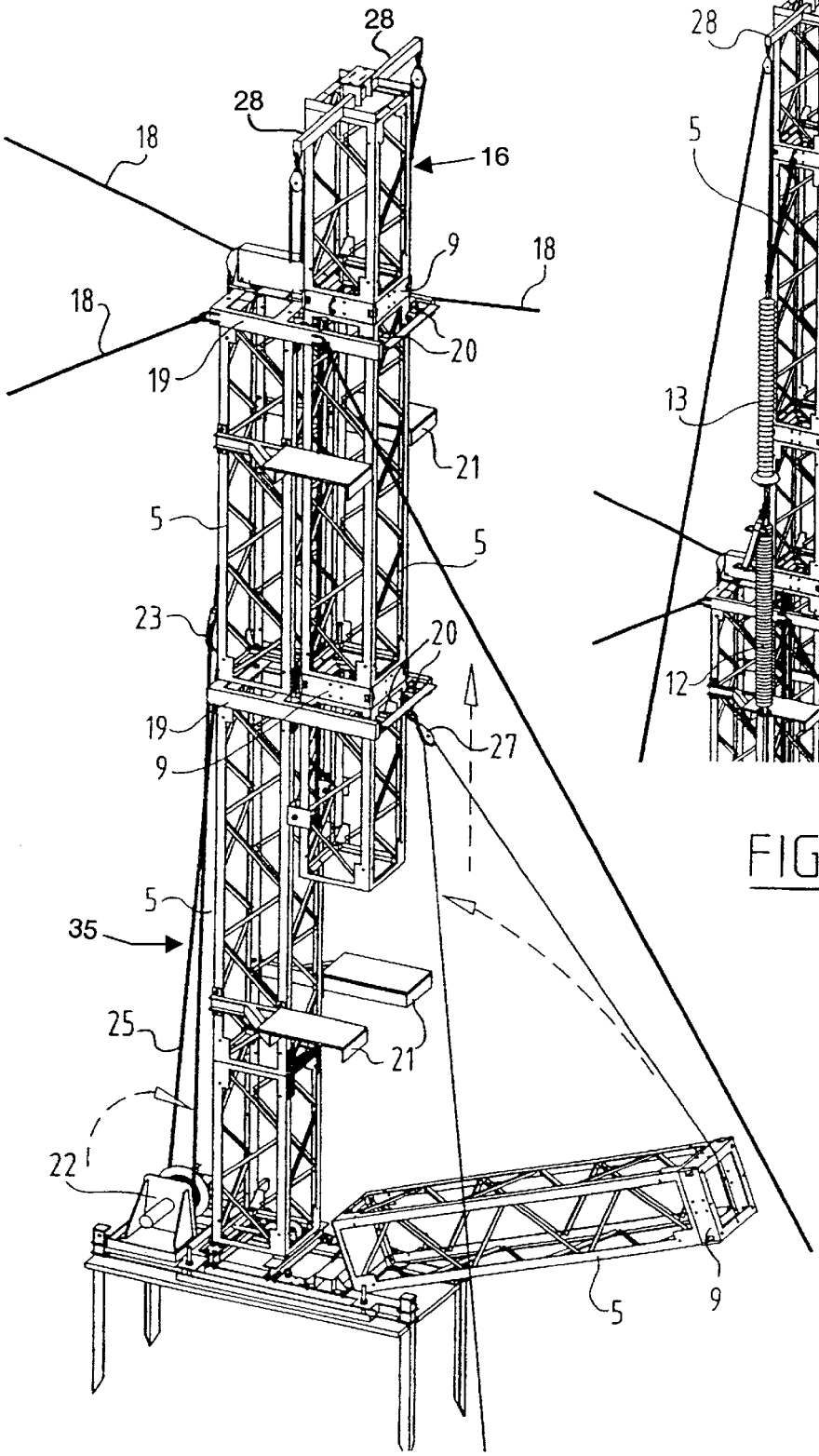
FIG. 3 is a perspective view of an apparatus for erecting a power pylon according to the invention.
Figure 4:
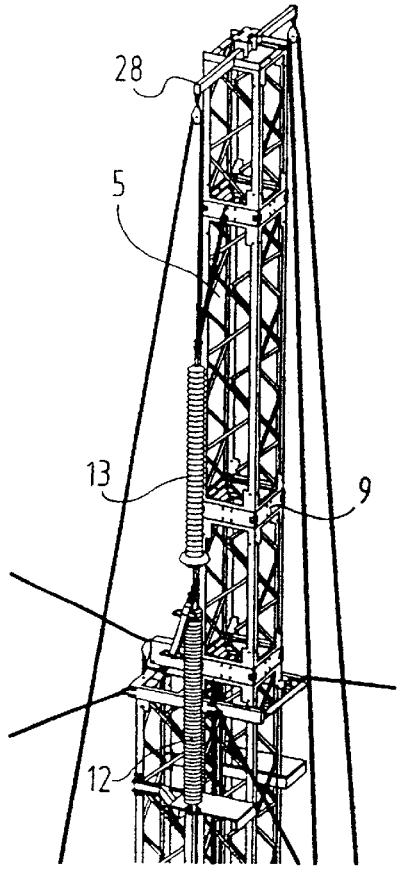
FIG. 4 is a perspective view of the top part of the power pylon according to the invention.

The erection of such a mast will be shown with reference to FIGS. 3 and 4 hereinbelow.

Ground plate 2 is initially placed on the ground 4 and fixed with pins 3, whereafter the apparatus for erecting the mast is constructed on the ground plate. This apparatus generally designated 35 is assembled from at least two, and in the present embodiment three, mast elements 5 which are mutually connected and subsequently erected using the winch. The apparatus is then guyed using guys 18 so that a sturdy entity is obtained.

Guide frames 19 are then arranged, wherein the distance between both guide frames 19 in vertical direction is smaller than the size of one of the mast elements and wherein the distance between the ground plate and the lowest guide device 19 is greater than one of the two elements. In the embodiment shown here the guide frames 19 are placed between the elements. This implies that the element 5 enclosed between guide frames 19 must be shorter than the normal mast elements 5 forming part of mast 1 so as to allow the guide frames to guide the mast elements.

Guide frames 19 are each fixed between the relevant mast elements 5 by means of for instance a bolt connection or by means of collars. On their inside the guide frames are provided with guide rollers 20 for upward guiding of the mast elements 5 to be erected.

Two pairs of step-on plates 21 are further arranged which serve as support during assembly.

The lifting device is then arranged. This is formed by a schematically shown winch 22, a first pulley 23 and a second pulley. Round the winch 22 is laid a cable 25 which is also trained round all other pulleys. The winch is preferably driven by a pneumatically or hydraulically driven motor. It is also possible however to make use of manual effort.

Erection of mast 1 is then initiated. For this purpose a first mast element 5 is arranged on the ground plate and erected. Use is made herein of a pulley 27 mounted on one of the guide frames and a cable trained thereover, one end of which is fastened to the element for erecting.

A hook fixed to the free end of cable 25 is here coupled to the bottom of the mast element and the relevant mast element 5 is hoisted upward using winch 22. A subsequent element 5 is then placed under the first element 5, whereafter the first element 5 is allowed to descend onto the lower element 5 using the winch, and both elements 5 are fixed to each other with for instance a bolt connection.

The point of attachment of the lifting device is then displaced and the thus described, partly completed mast is hoisted upward.

The same procedure is then repeated, this being continued until the mast has reached the required height.

It is noted here that junction boxes 9 are arranged between the relevant mast elements 5 during assembly. The junction boxes serve not only for fixing of the guys to be arranged later but also for mounting of the suspension devices 11 for the conductors. Junction boxes 9 are thus arranged at the lowest possible level, while they are moved upward during the further assembly of the mast.

Use is further made of a hoisting beam 28 which is fixed onto the uppermost element 5. This hoisting beam serves in the first instance for hoisting to assembly height of the insulators 12, 13 for fixing to the junction boxes 9. After being arranged at the desired height they are fixed to junction boxes 9 with the mounting means suitable for this purpose. They are also suitable for later lifting of guys or conductors when the actual mast 1 is completed. Finally, the hoisting beam 28 can serve as support for a neutral conductor.

It will be apparent that a simple and safe method is hereby provided for erecting such a mast, for which little equipment is necessary and which can be performed in its entirety with the equipment supplied therewith. Finally, it is pointed out that it is particularly attractive to combine in a container all the parts for assembling one, two or three masts. This container can then be transported using the usual transport means to the location where the mast has to be erected, so that the team entrusted with erection will find all parts inside the container.

Although the above invention relates in the first instance to the erecting of vertical masts, it can also be used to erect V-shaped masts, as per se known from the brochure referred to in the preamble.

What is claimed is:

1. Method for erecting a mast comprising mast elements placed one on top of another, comprising the following steps:

arranging a lifting device adjacent the location where an emergency mast is to be placed, said lifting device comprising at least one mast element from which at least two guide frames extend;

arranging a first mast element close of the lifting device;

raising the first mast element by means of the lifting device to a height such that an additional mast element can be placed under the first mast element;

placing the additional mast element under the first mast element and connecting said additional mast element to the first mast element situated thereabove;

raising the thus obtained combination of mast elements by means of the lifting device to a height such that a further additional mast element can be placed under the combination of said first and additional mast elements;

repeating the latter two steps until the mast has reached the required height, and removing the lifting device from said location adjacent the emergency mast.

2. Method as claimed in claim 1, characterized in that suspension means for high-voltage cables are fixed to the mast elements which are to be positioned high in the mast and in which said mast elements prior to being raised are situated at a low height adjacent the lifting device.

3. Method as claimed in claim 2, characterized in that prior to placing of the lifting device a platform is arranged at the location where the emergency mast is to be erected, and that the lifting device is placed on the platform.

4. Method as claimed in claim 2, characterized in that the suspension means are fixed to the mast elements while said elements can be reached by a person standing on a work platform.

5. Method as claimed in claim 4, characterized in that prior to placing of the lifting device a platform is arranged at the location where the emergency mast is to be erected, and that the lifting device is placed on the platform.

6. Method as claimed in claim 1, characterized in that prior to placing of the lifting device a platform is arranged at the location where the emergency mast is to be erected, and that the lifting device is placed on the platform.

7. Method as claimed in claim 1, characterized in that the mast is guyed after erecting of the mast.

8. Method as claimed in claim 7, characterized in that a hoisting beam is arranged on a first mast element and suspension means for power lines are carried to the height at which they are fixed to the mast element by said hoisting beam.

9. Method as claimed in claim 8, characterized in that subsequent to the mast being fully erected the hoisting beam is used for raising materials for fastening power lines to the suspension means.

10. Method as claimed in claim 1, characterized in that the mast elements are raised by means of a winch connected to the lifting device.

11. Method as claimed in claim 10, characterized in that a hoisting beam is arranged on the first mast element and suspension means for power lines are carried to the height at which they are fixed to the mast element by said hoisting beam.

12. Method as claimed in claim 11, characterized in that subsequent to the mast being fully erected the hoisting beam is used for raising fastening materials for fastening power lines to the suspension means.

13. Apparatus for erecting a mast formed from mast elements, comprising a lifting device for ground placement, guide frames mounted on said lifting device at a height from the ground at least as much as the height of a mast element for guiding the mast elements of the mast during erection, and a winch connected to the lifting device, characterized in that the lifting device comprises a temporary mast from which the guide frames extend said guide frames being spaced horizontally on said lift at a distance of at least the width of a mast element and protruding from said lift a distance exceeding the width of the mast element.

14. Apparatus as claimed in claim 13, characterized in that the winch is connected to a hydraulically or pneumatically driven motor.

15. Apparatus as claimed in claim 14, characterized in that the lifting means comprise at least two guide frame combinations which are arranged at different heights on the lift and which are each adapted to enclose the mast elements.

16. Apparatus as claimed in claim 14, characterized in that the lift device comprises at least two mast elements.

17. Apparatus as claimed in claim 13, characterized in that the lifting means comprise at least two guide frame combinations which are arranged at different heights on a portion of the lifting device and which are each adapted to provide side support for the mast elements.

18. Apparatus as claimed in claim 17, characterized in that the lift device comprises at least two mast elements.

19. Apparatus as claimed in claim 13, characterized in that the lifting device comprises at least two mast elements.

* * * * *